US006026995A

United States Patent [19]

Yamamoto et al.

[11] Patent Number: 6,026,995

[45] Date of Patent: Feb. 22, 2000

[54] APPARATUS AND METHOD FOR PRODUCING A THIN SOLIDIFIED ALLOY

[75] Inventors: Kazuhiko Yamamoto, Kobe; Takayuki Shibamoto, Ono; Yasuhiko Nakamura, Shiga-ken; Yasuki Mitsushima, Shiga-ken; Shigezi Sasaki, Shiga-ken, all of Japan

[73] Assignee: Santoku Metal Industry Company, Ltd., Japan

[21] Appl. No.: 09/117,220

[22] PCT Filed: Jan. 31, 1997

[86] PCT No.: PCT/JP97/00242

§ 371 Date: Jul. 24, 1998

§ 102(e) Date: Jul. 24, 1998

[87] PCT Pub. No.: WO97/27964

PCT Pub. Date: Aug. 7, 1997

[30] Foreign Application Priority Data

Feb. 2, 1996 [JP] Japan ..... 8-017913

[51] Int. Cl.[7] ..... B22D 37/00

[52] U.S. Cl. ..... 222/590; 222/591; 164/457; 164/136

[58] Field of Search ..... 222/590, 591, 222/604; 164/457, 136, 337

[56] References Cited

U.S. PATENT DOCUMENTS 5,381,855 1/1995 Mezger ..... 164/457
5,758,714 6/1998 Sato et al. ..... 164/457
5,792,378 8/1998 Christensen et al. ..... 222/590

FOREIGN PATENT DOCUMENTS 57-109548 7/1982 Japan .
59133969 7/1982 Japan .
60-49839 3/1985 Japan .
446665 2/1992 Japan .
5320832 12/1993 Japan .

*Primary Examiner*—Scott Kastler
*Attorney, Agent, or Firm*—Keil & Weinkauf

[57] ABSTRACT

An apparatus for producing thin solidified alloy pieces having a container 53 for accommodating an alloy melt 57, the container having an opening in an upper portion of the container, drive means 2 for titling the container for providing a flow of the alloy melt from the container, control means 4 for controlling the drive means, a cooling roll 55 for cooling and solidifying the alloy melt from the container into thin pieces, and flow stabilizing means 54 for guiding the alloy melt from the container onto the cooling roll in a substantially constant flow, wherein the control means includes memory means for storing tilting angular velocity commands for tilting the container, and commanding means for reading the tilting angular velocity commands in the memory means and for activating the drive means in accordance with the commands so read, wherein the tilting angular velocity commands in the memory means have been pre-set based on theoretical quantity of the alloy melt remaining in the container at each of a plurality of tilt angles selected so that the flow of the alloy melt from the container is substantially constant, and a method for producing thin solidified alloy pieces with this apparatus.

8 Claims, 3 Drawing Sheets

APPARATUS AND METHOD FOR PRODUCING A THIN SOLIDIFIED ALLOY

BACKGROUND OF THE INVENTION

The present invention relates to an apparatus for producing thin solidified alloy pieces and a method for producing thin solidified alloy pieces with this apparatus. For casting a variety of alloys, in particular for cooling and solidifying into thin pieces a melt of an alloy, such as a rare earth-containing alloy, that can be used for producing magnets, hydrogen storage alloys, alloys for anode of secondary batteries, or catalysts, flow of an alloy melt is supplied from a container via a flow stabilizing means such as a tundish onto a cooling roll. In such process, this apparatus can automatically provide a constant flow of the alloy melt from the container to produce thin solidified alloy pieces of a uniform thickness.

In alloy casting, there are generally known two methods for cooling and solidifying an alloy melt into thin pieces: namely, (1) directly guiding an alloy melt onto a cooling roll; and (2) guiding an alloy melt via a flow stabilizing means such as a tundish onto a cooling roll. The latter method (2) provides stabilization of the flow of the alloymelt, and control of the temperature of the alloy melt as well as the angle of the alloy melt to be guided onto the cooling roll. In method (2) , the alloy melt is usually accommodated in a container having a cylindrical or prismatic interior configuration with a top opening, and is made to flow over a portion of the edge of the top opening when the container is gradually tilted for guiding the alloy melt to the flow stabilizing means.

In this step, it is required to control the outflow of the alloy melt in order to keep the thickness of the resulting solidified pieces substantially uniform for achieving fixed and improved alloy properties.

For instance, controlling the flow rate of the alloy melt, which changes with the tilt angle of the container, to provide continuous and constant flow is quite difficult. The change in outflow of the alloy melt from the container is briefly explained below with reference to the drawings.

FIG. 3 illustrates how an alloy melt flows out of a container having cylindrical interior configuration with a circular top opening, in views seen horizontally from the front side of the top opening of the tilted container. FIG. 3(A) shows the state of container 1' at the beginning of tilting, wherein the flow rate of alloy melt 6 is relatively low. FIG. 3(B) depicts the state of container 1' at a tilt angle of about 45 degree, wherein the flow rate of alloy melt 6 is high. FIG. 3(C) indicates the state of container 1' at a tilt angle of about 90 degree, wherein little alloy melt 6 remains in container 1' so that the flow rate thereof is low.

In this way, the flow rate of the alloy melt changes with the tilt angle of the container. Consequently, if the tilting angular velocity of the container is fixed, the flow rate cannot be kept constant. To solve this problem to provide constant flow of the alloy melt from the container, there are proposed methods for controlling the flow rate of the alloy melt utilizing so-called feedback. For example, the control may be achieved by detecting the flow rate by a sensor, and contrasting the detected rate with the desired rate to decide the tilting angular velocity point by point; or by receiving the flow of the alloy melt from the container first in a tundish having a nozzle at its end, detecting the change in weight of the overall tundish by a load cell, and tilting the container when the detected value falls behind the predetermined lower limit, or stopping tilting the container when the detected value exceeds the predetermined upper limit.

In the former controlling method wherein the tilting angular velocity is decided point by point utilizing feedback, detection of the rate of continuously flowing alloy melt is required, which is difficult to carry out with accuracy and requires sensors with special equipment. In addition, since the decision of the tilting angular velocity is based on the detected flow rates, the control is likely to be deficient due to inadequate detection of the flow rate. To avoid this problem, the sensors are required to have high accuracy and durability, and controlling computer is demanded to have markedly high speed processing capacity, also causing economical problems. Also, the alloy melt of extremely high temperature necessitates heat resistance of the sensors. On the other hand, in the latter controlling method utilizing feedback from the load cell, not a little amount of alloy melt should be retained in the tundish, which inevitably requires large scale facilities. Moreover, in order to prevent unreasonable temperature drop of the alloy melt retained in the tundish, an apparatus for heating the alloy melt should be installed additionally.

Conventionally known flow stabilizing means for guiding a substantially constant flow of an alloy melt from the container onto the cooling roll include a tundish having a guiding passage for guiding the alloy melt toward the cooling roll and a nozzle for allowing the alloy melt from the guiding passage to flow down onto the cooling roll. The nozzle may be provided with a variety of passages for stabilizing the flow of the alloy melt. Upon starting a new flow cycle, the nozzle on such flow stabilizing means may sometimes be clogged up with the alloy melt remaining in the nozzle at the completion of the previous flow cycle. This is particularly true with a nozzle having the variety of passages for flow stabilization. Therefore, development of flow stabilizing means which will not be clogged up is also demanded.

DISCLOSURE OF THE INVENTION

It is an object of the present invention to provide an apparatus for producing thin solidified alloy pieces which can automatically provide by tilting the container a substantially constant flow of an alloy melt with accuracy from the container to flow stabilizing means without any special equipment, to prepare easily thin solidified alloy pieces in the form of ribbons or flakes of a uniform thickness, and a method for producing thin solidified alloy pieces with such apparatus.

It is another object of the present invention to provide an apparatus for producing thin solidified alloy pieces which guides by tilting a container a constant flow of an alloy melt from the container, onto a cooling roll under desired cooling conditions in a stable manner without causing easy clogging of the alloy melt, to prepare easily thin solidified alloy pieces of a uniform thickness, and a method for producing thin solidified alloy pieces with such apparatus.

According to the present invention, there is provided an apparatus for producing thin solidified alloy pieces comprising:

- a container for accommodating an alloy melt, said container having an opening in an upper portion of the container,
- drive means for tilting said container for providing a flow of the alloy melt from the container,
- controlling means for controlling said drive means,
- a cooling roll for cooling and solidifying the alloy melt from the container into thin pieces, and
- flow stabilizing means for guiding the alloy melt from the container onto said cooling roll in a substantially constant flow, wherein said control means includes memory means for storing tilting angular velocity commands for tilting the container, and commanding means for reading the tilting angular velocity commands in the memory means and for activating the drive means in accordance with the commands so read, wherein said tilting angular velocity commands in the memory means have been pre-set based on theoretical quantity of the alloy melt remaining in the container at each of a plurality of tilt angles selected so that the flow of the alloy melt from the container is substantially constant.

The flow stabilizing means is preferably a tundish having a bottom face for passing thereon the alloy melt from the container, side faces for preventing the alloy melt from flowing over the edges of the bottom face, and a rectifier provided at a location on the bottom face for reducing velocity of the flow of the alloy melt from the container to hold back the alloy melt and controlling temperature of the alloy melt, and for supplying the alloy melt substantially uniformly over a width of the cooling roll.

According to the present invention, there is also provided a method for producing thin solidified alloy pieces comprising the steps of:

tilting a container accommodating an alloy melt and having an opening in an upper portion of the container to continuously provide a substantially constant flow of the alloy melt, receiving said flow of the alloy melt from the container for stabilizing the flow, and supplying stabilized flow of the alloy melt onto a cooling roll, cooling and solidifying the alloy melt on the cooling roll into thin pieces of a substantially uniform thickness, and collecting the cooled and solidified thin alloy pieces, wherein said step of tilting is carried out under control at tilting angular velocities of the container having been pre-set based on theoretical quantity of the alloy melt remaining in the container at each of a plurality of tilt angles selected so that the flow of the alloy melt from the container is substantially constant.

PREFERRED EMBODIMENT OF THE INVENTION

Figure 1:
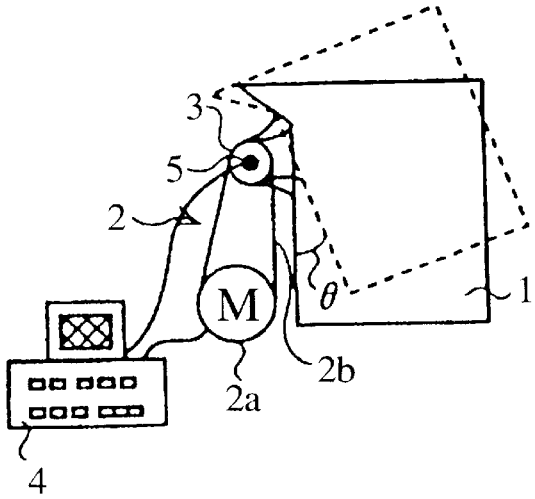
FIG. 1 is a schematic explanatory view illustrating a tilting and flow rate controlling mechanism of the apparatus of the present invention.

The apparatus of the present invention is essentially composed of a container, drive means, control means, a cooling roll, and flow stabilizing means.

The container may be of any type as long as it has an opening in its upper portion and is capable of accommodating an alloy melt therein. A crucible for melting the starting metal materials for preparing an alloy melt may be used for this purpose. The configuration of the container may be cylindrical, prismatic, or of other form with an opening of circular, rectangular, or other shape. Containers having a complex interior configuration which will cause difficulties in measuring the amount of the alloy melt remaining in the container are not preferred. The composition of the alloy melt is not particularly limited as long as the alloy is intended to be cast into thin solidified pieces in the form of ribbons, flakes, and the like. In particular, an alloy melt for producing rare earth-containing alloy pieces which exhibit varying properties depending on their thickness may be handled preferably with this method.

The drive means tilts the container for providing a flow of the alloy melt from the container. The drive means is a mechanical driving system having at least a conventional source of driving power such as an electric motor or a hydraulic motor, and a conventional transmission element, such as gears, for converting the driving power from the source into a force for tilting the container for further transmission.

The control means controls the drive means so that the flow of the alloy melt from the container is substantially constant. The control means has memory means for storing tilting angular velocity commands for tilting the container, and commanding means for reading the tilting angular velocity commands in the memory means and for activating the drive means in accordance with the commands so read.

The commanding means in the control means may basically be a conventional computer system in which a software for executing the control in accordance with the present invention is installed, or a hardware itself having a built-in circuit for executing the control in accordance with the present invention. The commanding means may include any associated interface and sensors necessary for applying conventional control techniques such as feedback control or open-loop control, which may be applied for controlling the drive means.

The memory means may be a memory IC, a magnetic or optical disc, or the like, but is not necessarily an independent medium or device. For example, space area in the memory in the commanding means may be assigned for this purpose to establish a memory area therein for storing the tilting angular velocity commands.

The tilting angular velocity commands which are stored in the memory means have been set in advance based on the theoretical quantity of the alloy melt remaining in the container at each of a plurality of tilt angles selected so that the flow of the alloy melt from the container is substantially constant.

The theoretical quantity of the alloy melt remaining in the container is not a value obtained by actual measurement, but a value theoretically calculated by mathematical technique on the basis of geometry of the container, the initial quantity of the alloy melt, and the tilt angle of the container.

Figure 2:
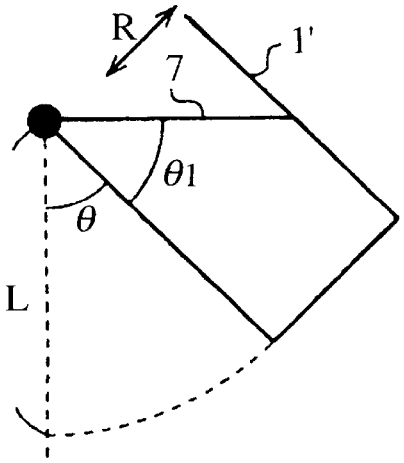
FIG. 2 illustrates schematically how to set the tilting angular velocity commands.
Figure 3:
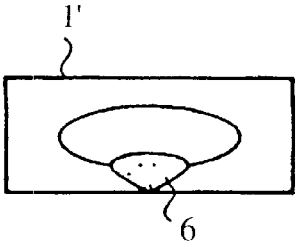
FIGS. 3(A) 3(B) and 3(C) are referential views illustrating the flowing process of the alloy melt at each tilt angle.
Figure 3:
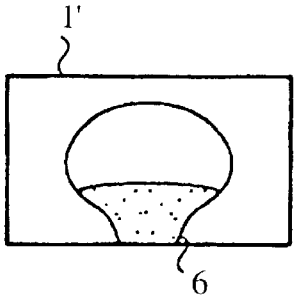
Figure 3:
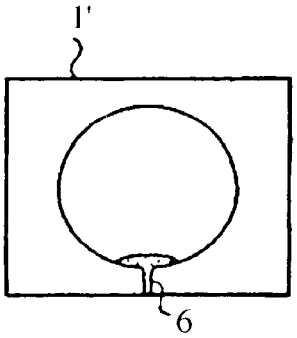

For example, referring to FIG. 2, wherein the container is at a tilt angle of $\theta$, the theoretical quantity of the alloy melt remaining in cylindrical container 1' may easily be calculated mathematically from the initial quantity of the alloy melt accommodated in the container, the height L and the radius R of container 1' , and angle $\theta_1$ between the liquid level 7 of the alloy melt in container 1' and container 1'. Since the dimensions of container 1' and the like are constants, the theoretical quantity is determined functionally with the tilt angle being a sole variable.

Incidentally, assuming that the liquid level of the alloy melt in the container is kept substantially perpendicular to the vertical while the container is tilted to discharge the alloy melt, angle $\theta_1$ is obtained by an equation of $\theta+\theta_1=\angle R$. In this case, viscosity of the alloy melt is not necessarily taken into account with ordinary alloy melts. However, with the alloy melt of extremely high viscosity, correction may be made to the above equation to improve the accuracy.

According to the present invention, the alloy melt outflow from the container when the container is tilted through a certain angle is calculated based on the above theoretical quantities of the alloy melt, and from the obtained outflow is calculated theoretical tilting angular velocity, i.e. tilting angular velocity commands for providing a constant flow of the alloy melt through that angle. This calculation is repeated for a plurality of tilt angle ranges. The number of tilt angle ranges over which the tilting angular velocity commands are to be determined may suitably be decided depending on the desired quantity and flow rate of the alloy melt to be discharged from the container so that the object of the present invention is achieved.

Following detailed discussion will help to understand how to determine the tilting angular velocity commands. For example, the alloy melt outflow Vn from the container when the tilt angle of the container is changed from θn-1 to θ n is obtained from the difference between the theoretical quantity v of the alloy melt remaining in the container at the tilt angle θ n and that at the tilt angle θn-1, and represented by the formula (1):

$$Vn=v(\theta n-1)-v(\theta n) \quad (1)$$

Thus, the tilting angular velocity required for providing a constant flow of the alloy melt from the container is obtained by the following procedure.

When the desired constant flow rate is denoted by W, the time Tn required for achieving the outflow Vn at the constant flow rate W is obtained by the formula (2):

$$Tn=Vn/W \quad (2)$$

Thus, the titling angular velocity command ϕ n applied over the tilt angle range of from θn-1 to θn (represented by d θ hereinbelow) is established by the formulae (3) and (3'):

$$\phi n=d\theta/Tn \quad (3)$$

$$=d\ \theta/Vn-W \quad (3').$$

The tilting angular velocity commands are established over a plurality of tilt angle ranges throughout the entire angle of tilting, to thereby provide a constant flow of the alloy melt throughout the operation. Incidentally, the above-mentioned value d θ, i.e. a range of the tilt angles over which a single tilting angular velocity command is applied may be constant throughout the entire angle of tilting. Alternatively, some tilt angle ranges may be narrower in angular regions requiring particular accuracy due to the desired quantity and flow rate of the alloy melt to be discharged as mentioned above. Thus, the tilt angle ranges may suitably be determined depending on the desired alloy thickness. Further, even if the tilting of the container is stopped midway and the alloy melt is not discharged once for all, the constant flow of the alloy melt may yet be provided easily by setting the tilting angular velocity commands in accordance with such stopping conditions.

The commanding means reads the tilting angular velocity commands stored in the memory means, and in accordance with the commands so read does it activate the drive means to tilt the container. Accordingly, the tilting angular velocity of the container is changed with the tilt angles, allowing the container to provide a substantially constant flow of the alloy melt.

The flow stabilizing means for guiding the substantially constant flow of the alloy melt from the container onto the cooling roll to be discussed later may be an ordinary tundish having a guiding passage and a nozzle at the end of the passage; or a tundish having a bottom face for passing the alloy melt thereon, and side faces for preventing the alloy melt from flowing over the edges of the bottom face. Preferred is a tundish which has a bottom face for passing thereon the alloy melt from the container, side faces for preventing the alloy melt from flowing over the edges of the bottom face, and a rectifier provided at a location on the bottom face for reducing velocity of the flow of the alloy melt from the container to hold back the alloy melt and controlling temperature of the alloy melt, and for supplying the alloy melt substantially uniformly over a width of the cooling roll. Use of the tundish facilitates temperature control of the alloy melt and regulation of the flow angle of the alloy melt with respect to the cooling roll, as well as stable guiding of the alloy melt onto the cooling roll without causing clogging in the tundish.

The rectifier may be a weir plate which may be disposed to interrupt the flow of the alloy melt on the bottom face of the tundish, and which has a plurality of paths for passing the alloy melt, spaced apart from each other and arranged in the transverse direction with respect to the flow direction of the alloy melt. The location of the weir plate on the bottom face of the tundish is not particularly limited as long as the above effect is obtained. For example, the weir plate may be disposed so that the adjacent streams of the alloy melt which have been passed through the plurality of paths in the weir plate contact with each other between the tip of the tundish (front end of the tundish with respect to the flow direction of the alloy melt) and the surface of the cooling roll. The upper side of the paths, i.e. the side opposite to the bottom face of the paths, may either be opened or closed. In the latter case, it is preferred to control the flow rate so that the flow of the alloy melt will not touch the upper side of the paths. The bottom face of the tundish may be sloped downward in the flow direction of the alloy melt. In this case, the rectifier is preferably disposed downstream of the slope, i.e. on the cooling roll side of the slope.

The cooling roll for cooling and solidifying the alloy melt passed through the flow stabilizing means into thin pieces of a desired thickness is of an ordinary drum type associated with a drive unit for rotating the roll at desired speed. The cooling surface of the roll may be made of copper, a Cr—Cu alloy, or a Be—Cu alloy as of a conventional roll. The cooling roll may be provided with roll surface cooling means such as water channels disposed in the drum.

The apparatus of the present invention in its entirety may be kept under an inert atmosphere or under reduced pressure when, for example, the alloy melt employed and the resulting alloy pieces are susceptible to air, like rare earth-containing alloys. Further, since the thin solidified alloy pieces having been cooled and solidified on the cooling roll are usually in the form of ribbons or strips, a conventional apparatus for processing the ribbons or strips into flakes or powders may be added to the system.

The method for producing thin solidified alloy pieces of the present invention may be carried out with the above-mentioned apparatus. Specifically, the container accommodating the alloy melt and associated with the drive means and the control means is tilted under control of the control means to continuously provide through the opening of the container a substantially constant flow of the alloy melt, which is then stabilized through the flow stabilizing means. The stabilized flow of the alloy melt is supplied onto the cooling roll, where the alloy melt is cooled and solidified into thin pieces of a substantially uniform thickness, which leave the cooling roll with the rotation of the roll. The thin alloy pieces removed from the cooling roll may be collected as they are and passed to a subsequent step of processing the pieces into a desired form, such as flakes or powders. Alternatively, the thin alloy pieces may be crushed into flakes as they fall from the roll, by an impaction plate disposed at a location for allowing the falling alloy pieces to impact thereon. The above series of operation may be carried out under an inert atmosphere or under reduced pressure, if required, and the resulting alloy products may be collected and sealed in a container under an inert atmosphere.

According to the present invention, control of the tilting angular velocity of the container in accordance with the pre-set tilting angular velocity commands eliminates the need for special, complicated equipment, reduces risk of erroneous operation, and provides automatically a substantially constant flow of the alloy melt from the container at low cost, allowing easy production of thin solidified alloy pieces of a substantially uniform thickness. The present invention is particularly effective for producing rare earth-containing alloys.

EXAMPLES

The present invention will now be explained with reference to a preferred embodiment taken in conjunction with attached drawings.

FIG. 1 is a schematic explanatory view illustrating a tilting and flow rate controlling mechanism for tilting the container used in the apparatus for producing thin solidified alloy pieces of the present invention.

The control system is composed of rotary encoder 5 mounted on axial shaft 3, on which container 1 is tilted, drive unit 2 for tilting container 1, and host computer 4 electrically connected to encoder 5 and drive unit 2.

Rotary encoder 5 is a rotational position sensor which detects the rotation angle of axial shaft 3 and transmits the obtained information to host computer 4.

Drive unit 2 includes motor 2*a* acting as a drive source and chain mechanism 2*b* for transmitting the driving force to axial shaft 3.

Host computer 4 provides feedback control of motor 2*a* in accordance with the rotation angle information from rotary encoder 5, and has a memory wherein a tilting angular velocity table relating to each tilt angle of container 1 has been stored.

The tilting angular velocity table is a set of tilting angular velocity commands established in advance for changing the tilting angular velocity of container 1 for every predetermined tilt angle range. The tilting angular velocity commands correspond to values theoretically calculated from the dimensions of container 1 and from the initial quantity of the alloy melt accommodated in container 1 in accordance with the above-discussed process, each of which values is calculated and established for each and every tilt angle range over the entire angle of tilting. Accordingly, tilting container 1 at the angular velocities given by the tilting angular velocity commands will provide a substantially constant flow of the alloy melt from the container.

Next is discussed operation for control.

Host computer 4 reads the angular velocity commands from the tilting angular velocity table in the memory, and according to these commands, exercises the feedback control over motor 2*a*, to thereby make container 1 to start tilting. Rotary encoder 5 functions to establish, in cooperation with host computer 4, feedback system for controlling motor 2*a* and to inform host computer 4 of the tilt angle of container 1, so that host computer 4 recognizes the tilt angle of container 1 at all times. When the container reaches the tilt angle at which the angular velocity should be changed, host computer 4 reads the next angular velocity commands corresponding to that tilt angle from the tilting angular velocity table to control motor 2*a* in accordance with the commands so read. As a result, container 1 is tilted at tilting angular velocities corresponding to the angular velocity commands, which reduces fluctuation in the flow rate with the change in the tilt angle, keeping the flow rate substantially constant.

This operation is repeated until a predetermined quantity of the alloy melt is discharged from container 1, while the flow rate therefrom is kept constant at all times.

Next, with regard to open-loop control over motor 2*a* by host computer 4, supplementary description is given. Open-loop control eliminates the need for rotary encoder 5, which, however, makes host computer 4 unable to recognize the actual tilt angle of container 1, and thus the timing to change the tilting angular velocity. However, this problem may be solved by incorporating an additional software into host computer 4 to provide a timer. Since time Tn for which tilting angular velocity $\phi n$ is applied is predetermined, the timer is set for time Tn to give a cue to change the tilting angular velocity, instead of changing the tilting angular velocity in accordance with the actual tilt angle of container 1 as in the former case.

Figure 4:
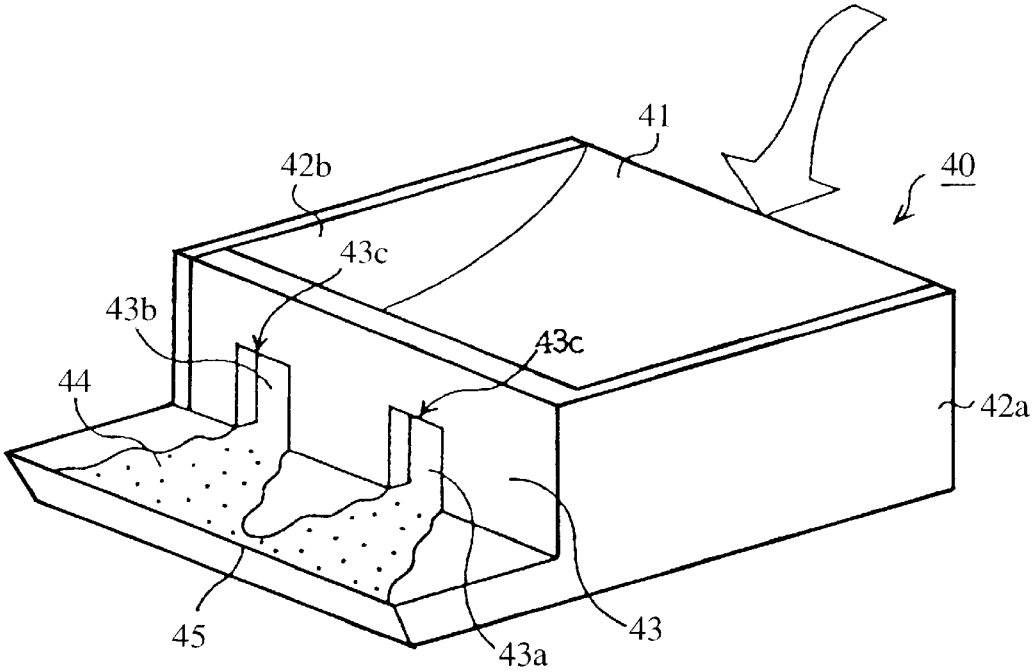
FIG. 4 is a schematic view depicting a preferred embodiment of a tundish used in the apparatus for producing thin solidified alloy pieces of the present invention.

Referring now to FIG. 4 is discussed a preferred embodiment of a tundish for supplying onto the cooling roll the alloy melt discharged at a constant flow rate from the container equipped with the tilting and flow rate controlling mechanism shown in FIG. 1.

In FIG. 4, tundish 40 is made up of bottom face 41 on which the alloy melt discharged from the container is passed in the direction of the arrow, side faces 42*a*, 42*b* for preventing the alloy melt from flowing over the edges of the bottom face, and weir plate 43 having two alloy melt paths 43*a*, 43*b* spaced apart from each other.

Bottom face 41 receives a flow of the alloy melt as shown in the figure, and is sloped gently downstream. Weir plate 43 is disposed on the bottom face where the slope becomes substantially horizontal to divide the flow of the alloy melt passed from the slope, to hold back and rectify the flow, and to control the temperature of the alloy melt to a desired level.

At weir plate 43, the flow of the alloy melt temporarily forms a pool on the side of the slope to delay the flow velocity of the alloy melt, and is then divided and allowed to flow through the paths 43*a*, 43*b*. The divided flows of the alloy melt merge at the tip 45 of the tundish and are supplied as alloy melt 44 onto the cooling roll at a substantially constant rate, keeping its width within the width of the cooling roll. The number of paths 43*a*, 43*b* is not limited to two, but usually 2 to 10 paths may be provided through the weir plate depending on the width of the tundish. The divided flows of the alloy melt are passed through the paths 43*a*, 43*b* so that they will not contact the upper surface 43*c* of the paths for preventing clogging. When a large quantity of alloy melt is designed to be passed per unit time, open type weir plate without the upper surface 43*c* may be used.

Figure 5:
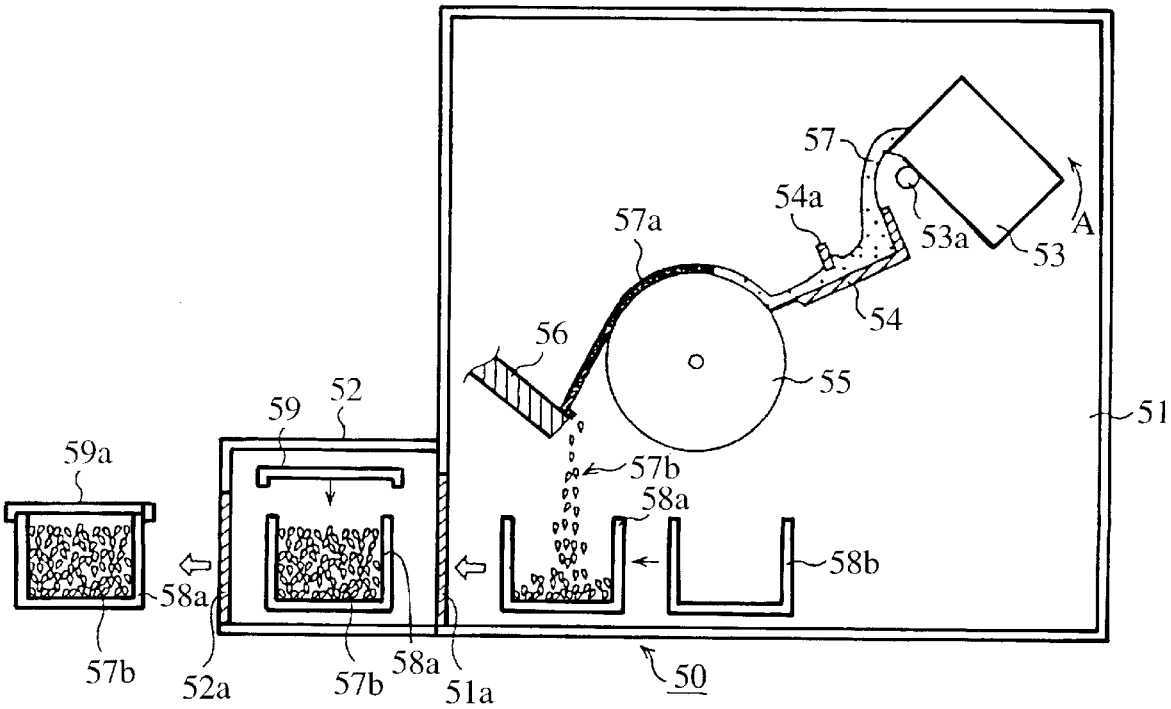
FIG. 5 is a schematic view showing an embodiment of the apparatus for producing thin solidified alloy pieces of the present invention.

Referring to FIG. 5, a preferred embodiment of an apparatus for producing thin solidified alloy pieces of the present invention is explained.

In FIG. 5, apparatus 50 is enclosed in first and second gastight chambers 51, 52, in which an inert gas atmosphere or reduced pressure may be established. First chamber 51 encloses container 53 which contains an alloy melt and has the tilting and flow rate controlling mechanism (not shown) of FIG. 1, roll 55 for cooling and solidifying alloy melt 57 discharged in a constant flow from container 53 into thin pieces, tundish 54 as explained with reference to FIG. 4 for guiding alloy melt 57 from container 53 to cooling roll 55, alloy crushing plate 56 for crushing thin alloy pieces 57*a* from the cooling roll 55 merely by allowing the alloy pieces 57 a to impinge on the plate, and sealable container 58*a*, 58*b* for collecting crushed alloy pieces 57*b*. First chamber 51 has a closing shutter 51*a* at a location where it communicates with second chamber 52 for maintaining the chamber 51 gastight.

Container 53 is tilted on axis 53*a* in the direction shown by arrow A by means of the tilting and flow rate controlling mechanism as shown in FIG. 1 to provide a substantially constant flow of alloy melt 57 to tundish 54.

Tundish 54 rectifies the flow of alloy melt 57 from container 53 with weir plate 54*a* to provide a substantially constant flow of alloy melt 57 onto cooling roll 55, while it prevents the alloy melt 57 from flowing over its edges.

Cooling roll 55 has the outer surface, which is made of a material applicable to cool alloy melt 57, such as copper, and is provided with a drive unit (not shown) for rotating the roll at a constant angular velocity.

Alloy crushing plate 56 is a metal plate disposed at a location for allowing the thin alloy pieces 57*a* from the cooling roll to impinge on the plate continuously. Below the alloy crushing plate 56 is placed a highly gastight metal container 58*a*, which is displaceable in the direction of the arrow. When a sensor (not shown) detects that container 58*a* is filled with crushed alloy 57*b*, shutter 51*a* is opened, container 58*a* is transferred into second chamber 52, and container 58*b* is transferred to under alloy crushing plate 56. Such transfer of the containers is effected by a belt conveyor (not shown).

The second chamber encloses an apparatus (not shown) for attaching one by one a gastight cover to container 58*a* filled with crushed alloy 57*b*, and has an opening gastight shutter 52*a* for taking the sealed container 58*a* out of the second chamber 52.

A method for producing thin solidified alloy pieces with the apparatus shown in FIG. 5 is to be explained in detail.

A desired inert gas atmosphere or reduced pressure was established inside the first chamber 51. 165.0 kg of neodymium metal, 329.0 kg of iron, and 6.0 kg of boron were charged in an alumina crucible 53 having the inner diameter of 440 mm ϕ and the depth of 690 mm, and subjected to high frequency melting to obtain 500 kg of alloy melt for magnets. Then the crucible 53 was tilted gradually on axis 53*a* in the direction shown by arrow A by means of a tilting and flow rate controlling mechanism to discharge alloy melt 57 continuously. For tilting, the tilting angular velocity commands for each tilt angle range had been set so that the flow rate (W) of alloy melt 57 from the container is 712 g/sec. Alloy melt 57 discharged from container 53 was passed onto tundish 54, where the flow of alloy melt 57 was rectified by weir plate 54*a*, and then continuously injected onto the outer surface of cooling roll 55 having the outer diameter of 500 mm ϕ and the width of 700 mm and rotating at a peripheral speed of 1.57 m/sec. The alloy melt 57 was cooled on the outer surface of roll 55 at a predetermined cooling rate, to thereby giving thin alloy pieces 57*a*. The alloy pieces 57*a* successively left the roll 55 with the rotation of the roll, and were driven against alloy crushing plate 56 to be crushed into alloy flakes 57*b*, which fell into container 58*a* disposed below the plate 56.

Figure 6:
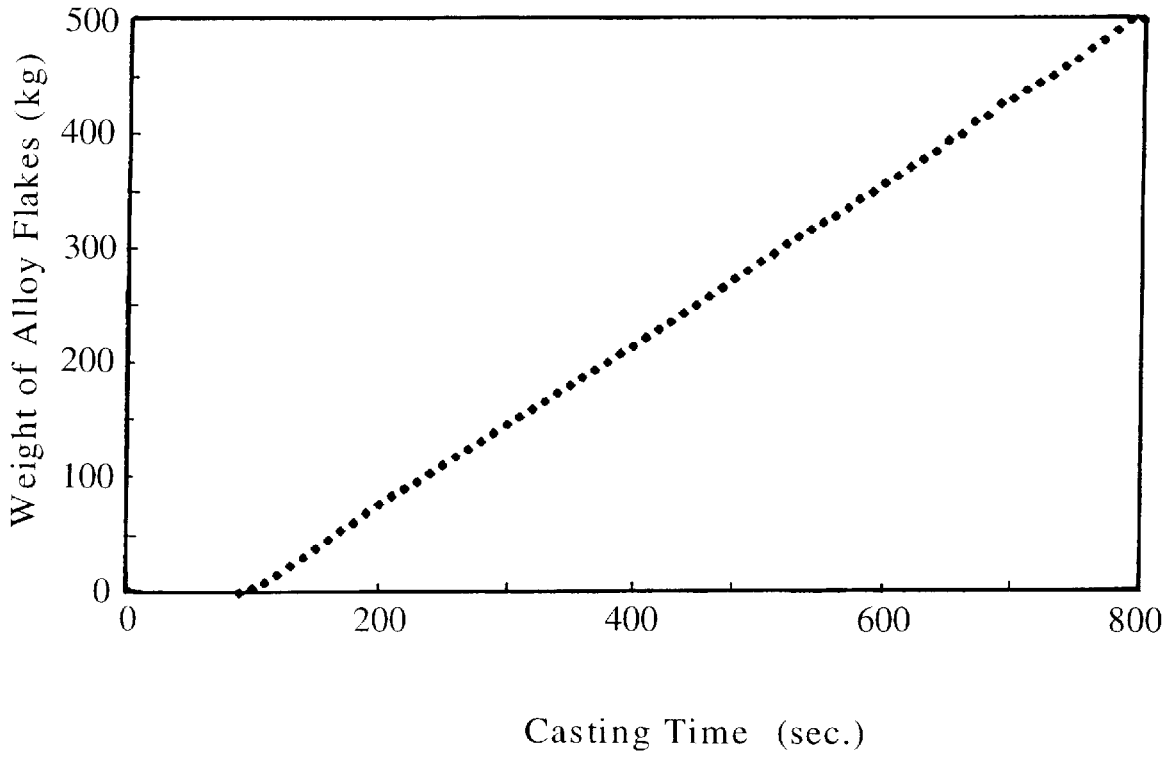
FIG. 6 is a graph showing change in the cast amount of the alloy with respect to time as measured in Example.

Container 58*a* was provided with a measuring device for recording the amount of the cast alloy, with which the change in the amount of the cast alloy with the lapse of time was measured. The results are shown in FIG. 6. The figure shows that the weight of alloy flakes 57*b* and the alloy casting time had linear relationship, with the coefficient of correlation r being 0.999.

Container 58*a* filled with alloy flakes 57*b* was transferred from the first chamber 51 to the second chamber 52, where container 58*a* was sealed, and then taken out of the second chamber 52. Thirty samples of the obtained alloy flakes 57*b* were taken out by quartering, and subjected to measurement of the thickness with a micrometer. It was found that the average thickness of the alloy flakes was 0.259 mm, the standard deviation was 0.009, and the variance was 0.0001.

What is claimed is:

1. An apparatus for producing thin solidified alloy pieces comprising:

a container for accommodating an alloy melt, said container having an opening in an upper portion of the container, drive means for tilting said container for providing a flow of the alloy melt from the container, control means for controlling said drive means, a cooling roll for cooling and solidifying the alloy melt from the container into thin pieces, and flow stabilizing means for guiding the alloy melt from the container onto said cooling roll in a substantially constant flow, wherein said control means includes memory means for storing tilting angular velocity commands for tilting the container, and commanding means for reading the tilting angular velocity commands in the memory means and for activating the drive means in accordance with the commands so read, wherein said tilting angular velocity commands in the memory means have been pre-set based on theoretical quantity of the alloy melt remaining in the container at each of a plurality of tilt angles selected so that the flow of the alloy melt from the container is substantially constant.

2. The apparatus of claim 1 wherein said flow stabilizing means is a tundish having a bottom face for passing thereon the alloy melt from the container, side faces for preventing the alloy melt from flowing over edges of the bottom face, and a rectifier provided at a location on the bottom face for reducing velocity of the flow of the alloy melt from the container to hold back the alloy melt and controlling temperature of the alloy melt, and for supplying the alloy melt substantially uniformly over a width of the cooling roll.

3. The apparatus of claim 2 wherein said rectifier is a weir plate provided at right angle to flow direction of the alloy melt, and having a plurality of paths for passing the alloy melt.

4. A method for producing thin solidified alloy pieces comprising the steps of:

tilting a container accommodating an alloy melt and having an opening in an upper portion of the container under control in accordance with tilting angular velocity commands for providing a flow of the alloy melt from the container, receiving said flow of the alloy melt from the container for stabilizing the flow, and supplying stabilized flow of the alloy melt onto a cooling roll, cooling and solidifying the alloy melt on the cooling roll into thin pieces of a substantially uniform thickness, and collecting the cooled and solidified thin alloy pieces, wherein said method further comprises, prior to said step of tilting a container under control, the step of:

setting said tilting angular velocity commands so that the alloy melt is discharged from the container at a substantially constant flow rate, based on the difference in angle between arbitrary tilt angles and on outflow of the alloy melt discharged from the container between said arbitrary tilt angles, said outflow of the alloy melt being regarded as the difference between said arbitrary tilt angles in theoretical quantity of the alloy melt remaining in the container calculated on assumption that level of the alloy melt in the container is kept horizontal.

5. The method of claim 4 wherein said alloy melt is a melt of a rare earth-containing alloy.

6. An apparatus for producing thin solidified alloy pieces comprising:

a container for accommodating an alloy melt, said container having an opening in an upper portion of the container, drive means for tilting said container for providing a flow of the alloy melt from the container, control means for controlling said drive means, a cooling roll for cooling and solidifying the alloy melt from the container into thin pieces, and flow stabilizing means for guiding the alloy melt from the container onto said cooling roll in a substantially constant flow, wherein said control means includes memory means for storing tilting angular velocity commands for tilting the container, and commanding means for reading the tilting angular velocity commands in the memory means and for activating the drive means in accordance with the commands so read, wherein said tilting angular velocity commands in the memory means have been pre-set so that the alloy melt is discharged from the container at a substantially constant flow rate, based on difference in angle between arbitrary tilt angles and on outflow of the alloy melt discharged from the container between said arbitrary tilt angles in theoretical quantity of the alloy melt remaining in the container calculated on assumption that level of the alloy melt in the container is kept horizontal.

7. The apparatus of claim 6, wherein said flow stabilizing means is a tundish having a bottom face for passing thereon the alloy melt from the container, side faces for preventing the alloy melt from flowing over edges of the bottom face, and a rectifier provided at a location on the bottom face for reducing velocity of the flow of the alloy melt from the container to hold back the alloy melt and controlling temperature of the alloy melt, and for supplying the alloy melt substantially uniformly over a width of the cooling roll.

8. The apparatus of claim 7, wherein said rectifier is a weir plate provided at right angle to flow direction of the alloy melt, and having a plurality of paths for passing the alloy melt.

* * * * *

UNITED STATES PATENT AND TRADEMARK OFFICE

CERTIFICATE OF CORRECTION

PATENT NO.: 6,026,995

DATED: February 22, 2000

INVENTOR(S): YAMAMOTO et al.

It is certified that error appears in the above-identified patent and that said Letters Patent is hereby corrected as shown below:

Column 12, claim 6, line 19, after "angles" insert --said outflow of the alloy melt being regarded as difference between said arbitrary tile angles --.

Signed and Sealed this

Twenty-sixth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,026,995
DATED : February 22, 2000
INVENTOR(S) : Yamamoto et al.

It is certified that error appears in the above-identified patent and that said Letters Patent is hereby corrected as shown below:

Column 12, claim 6,
Line 19, after "angles" insert -- said outflow of the alloy melt being regarded as difference between said arbitrary tile angles --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,026,995
DATED : February 22, 2000
INVENTOR(S) : Yamamoto et al.

It is certified that error appears in the above-identified patent and that said Letters Patent is hereby corrected as shown below:

Column 12, claim 6,
Line 19, after "angles" insert -- said outflow of the alloy melt being regarded as difference between said arbitrary tilt angles --.

This certificate supersedes Certificate of Correction issued October 30, 2001.

Signed and Sealed this

Nineteenth Day of February, 2002

*Attest:*

*Attesting Officer*

JAMES E. ROGAN
*Director of the United States Patent and Trademark Office*